United States Patent [19]

Dickakian

[11] Patent Number: 4,581,123

[45] Date of Patent: Apr. 8, 1986

[54] CUSTOM BLENDED PRECURSOR FOR CARBON ARTIFACT MANUFACTURE

[75] Inventor: Ghazi Dickakian, Greenville, S.C.

[73] Assignee: E. I. Du Pont de Nemours and Company, Wilmington, Del.

[21] Appl. No.: 731,632

[22] Filed: May 7, 1985

Related U.S. Application Data

[63] Continuation of Ser. No. 479,294, Mar. 28, 1983.

[51] Int. Cl.[4] ..... C10C 3/00; C10C 3/08

[52] U.S. Cl. ..... 208/23; 208/39; 208/45; 423/447.1

[58] Field of Search ..... 208/23, 39, 45; 423/447.1, 447.2, 447.4

[56] References Cited

U.S. PATENT DOCUMENTS

| | | | |
|---|---|---|---|
| 4,096,056 | 6/1978 | Haywood et al. | 208/22 |
| 4,184,942 | 1/1980 | Angier et al. | 208/44 |
| 4,188,235 | 2/1980 | Espenscheid et al. | 208/23 |
| 4,431,512 | 2/1984 | Dickakian | 208/44 |
| 4,431,623 | 2/1984 | Fug | 208/44 |
| 4,443,324 | 4/1984 | Diefendorf et al. | 208/45 |
| 4,454,020 | 6/1984 | Izumi et al. | 208/22 |

*Primary Examiner*—D. E. Gantz
*Assistant Examiner*—Helane Myers

[57] ABSTRACT

This invention is based upon a new concept in carbon artifact manufacture, wherein a precursor can be manufactured by blending extracted components of at least one pitch to give an optimized mixture having the proper chemistries and rheology to provide high strength carbon artifacts.

4 Claims, 3 Drawing Figures

Relation of As-spun Fibers Composition to Fiber Strength

CUSTOM BLENDED PRECURSOR FOR CARBON ARTIFACT MANUFACTURE

This application is a continuation of Ser. No. 479,294, filed Mar. 28, 1983.

FIELD OF THE INVENTION

This invention relates to the manufacture of carbon artifacts such as carbon fibers, and more particularly to a new precursor for carbon artifact manufacture that is custom blended from individual and distinct components of one or more feedstocks.

BACKGROUND OF THE INVENTION

In the production of carbon artifacts, such as carbon fibers, various chemical and physical processes are used to transform feedstocks and fractions of feedstocks into suitable precursors. Major efforts are being made to obtain a better understanding of the required chemistries.

It has been determined that a deasphaltenated middle fraction of a feedstock can be subsequently heat soaked and vacuum stripped to provide a precursor material suitable for carbon fiber manufacture. Such a teaching is to be found in patent applications assigned to a common assignee, bearing Ser. Nos. 346,623 now U.S. Pat. No. 4,431,512; 346,624 now U.S. Pat. No. 4,427,530 and 346,625 now abandoned, each filed on Feb. 8, 1982.

A polycondensed aromatic feedstock can be transformed into a pitch precursor by a variety of thermal or catalytic processes. For example, Ashland pitch nos. 240,170 or 212 can be produced by a thermal-treatment of catalytic cracking residue. Catalytic cracking residue pitch is produced according to U.S. Pat. No. 4,271,006 by a vacuum heat-soaking process or by heat-soaking a steam cracking tar residue as described in U.S. application Ser. No. 273,200 now U.S. Pat. No. 4,414,095, or by heat-soaking a distillate of a steam cracking tar residue in accordance with U.S. Ser. Nos. 399,751 now abandoned and 346,623 now U.S. Pat. No. 4,431,512 or by heat-soaking distillate from coal processing such as in a coal liquefication process according to U.S. application Ser. Nos. 399,702 now U.S. Pat. No. 4,518,482; 399,472 now U.S. Pat. No. 4,448,670 and 346,625 now abandoned.

An understanding of the characteristics and the chemical structure of the various molecules (or parts) of a pitch precursor is necessary to process and spin the pitch (or fraction) into 8–12 microns "green" fibers. After spinning, the precursor is oxidized (at 220°–300° C.) to transform the "green" fiber infusable, and then, carbonized at 1400°–2000° C. into high tensile strength carbon fibers.

In every instance, to the best of our knowledge and belief, a given feedstock or fraction thereof has been treated or transformed to provide a precursor material for carbon artifact manufacture.

No one, to the best of our knowledge and belief, has ever suggested blending specific fractions or components of one or more pitches to provide a customized precursor.

This invention is based upon a new concept in carbon artifact manufacture, wherein a precursor can be manufactured by blending extracted components of at least one pitch to give an optimized mixture having the proper chemistries and rheology to provide high strength carbon artifacts.

High tensile strength pitch-derived carbon fibers are produced by spinning a carbonaceous material with a specific composition of matter. This composition, generally speaking, comprises two major parts: (1) a low molecular weight, low aromaticity, isotropic, volatile plasticizer part; and (2) a high softening, high aromaticity, thermally-stable, anisotropic part. These two parts must be present in appropriate proportions to produce a molten carbonaceous material with the desired softening, fluidity, rheology, volatility and stability suitable for producing high strength carbon fibers.

More specifically, the invention has further defined and separated individual components within these two major fractions, and has further blended these components in given proportions to provide a customized blend.

Still further, this invention recognizes that individual components can be cross-blended from different feedstocks, e.g. oxidizable components from a coal distillate feedstock pitch can be blended with plasticizers from a cat cracker bottom feedstock pitch.

This invention has realized that not all pitches or fractions of pitches are suitable for carbon fiber production, and that too much or too little of certain components can severely effect the final carbon artifact product.

The invention contemplates custom blending individual pitch components to provide a precursor for carbon fiber production having the following general characteristics:

1. A precursor having highly polycondensed aromatics with minimum alkyl side chains. This characteristic can quantitatively be determined by nuclear magnetic resonance spectroscopy and by measuring the carbon/-hydrogen atomic ratio.

2. A precursor having a relatively high molecular weight as measured by gel permeation chromatography.

3. A precursor which is highly anisotropic (high liquid crystal) in structure or is able to transform into a highly anisotropic structure on further heating for a short time in a nitrogen atmosphere.

4. A precursor having satisfactory rheological properties (viscosity or softening characteristics) so it can be spun into 8–12 micro fibers.

5. A precursor which is thermally and chemically stable so it does not decompose or change its chemical structure during spinning at a temperature such as 340°–380° C., and pressure.

6. A precursor having a specific composition of the low boiling volatiles, a low softening plasticizer fraction of one or more components and high molecular weight and high softening fractions which provide the skelton for the carbon fiber.

A typical cat cracker bottom pitch can be separated into eight components or fractions by solvent extraction techniques:

1. Quinoline Insolubles (fraction "$O_3$"). Extracted with Quinoline at 75° C.;

2. Pyridine Insolubles—Quinoline Solubles (fraction "$O_2$"). Extraction with pyridine at reflux and Quinoline at 75° C.

3. Pyridine Insolubles (fraction "$O_2+O_3$"). Extraction with pyridine at reflux;

4. Toluene Insolubles—Pyridine Solubles (fraction "$O_1$"). Extraction with Toluene at reflux and then Pyridine at reflux;

5. Toluene Insolubles (fractions "$O_1+O_2+O_3$" and "$P_1+P_2$"). Extraction with toluene at reflux;

6. n-Heptane Insolubles—Toluene Solubles (fraction "$P_2$"). Extraction by n-Heptane at reflux and then toluene at reflux; and 7. n-Heptane Solubles (fraction "$P_1$"). Extraction by n-Heptane at reflux.

The composition analysis is carried out as follows: the material to be tested is introduced into a glass reactor equipped with a mechanical agitator and electrically heated from the outside. The solvent is then added and the mixture agitated vigorously and heated to the desired temperature for the desired time. The insolubles are filtered using fritered glass filters, dried under reduced pressure at around 100° C. and the insolubles yield calculated. Summary of the conditions of the solvent analysis is as follows:

| Test | Feed: Solvent Ratio | Time (hrs.) | Temperature (°C.) |
|---|---|---|---|
| n-heptane Insolubles | 1:50 | 2.0 | 105 |
| Toluene Insolubles | 1:50 | 1.0 | 110 |
| Pyridine Insolubles | 1:50 | 1.0 | 114 |
| Quinoline Insolubles | 1:12 | 4 | 75 |

Five of these eight components ($O_1$; $O_2$; $O_3$; $P_1$ and $P_2$) can now be individually blended in proportions not commonly obtained in the original pitch.

For example, the "$P_2$" component which is usually present in the total cat cracker bottom pitch in a percentage by weight of between 10 and 20%, can now be blended into a customized precursor mixture in a lower percentage such as 5% or a higher percentage such as 30%. The other components can be likewise manipulated.

Thus, a precursor can be fabricated, which has characteristics never before achieved by conventional fractional treatments or by processing.

Even more interesting is the concept of cross-blending pitch components derived from different feedstocks such as: cat cracker bottoms; steam cracker tars; coal distillates; etc.

In addition, synthetic materials may also be added to the customized blend.

Synthetic materials suitable as components for preparing a carbon precursor of our invention can be one or more of the following:

(a) Heat-soaked pitch derived from catalytic cracking residue or its distillate prepared according to the copending application Ser. Nos. 225,060; 399,750 and 346,624.

(b) Heat-soaked pitch derived from steam cracking tar or its distillate according to the process described in the copending application Ser. Nos. 346,623 and 399,751.

(c) Heat-soaked pitch derived from coal tar distillate from coal processing by using the process described in copending application Ser. Nos. 399,472 and 399,702.

The above copending applications are meant to be incorporated herein by way of reference.

Furthermore, in manufacturing processes where precursors are made continuously or in large bulk, the exact characteristics and properties are very difficult to achieve. Small unwanted changes in temperature and pressure may produce a precursor with an unacceptable level of a particular fraction. By custom blending the precursor, this invention can provide the certainty that the correct amount of any component or fraction will be in the final product. Thus, a precursor having specific composition and a final product having exact and specific characteristics can be provided at will.

DISCUSSION OF RELATED ART

In the past, it has been known to characterize or define various and sundry fractions of pitch materials.

To the best of our knowledge and belief, this invention for the first time teaches the custom blending of different components or fractions of pitches to achieve a precursor having a specific and controllable composition. This type of precursor will be capable of providing a final carbon artifact product of higher strength and quality.

In addition, this invention correlates the relationship between various component fractions of the precursor and the strength of the final product.

SUMMARY OF THE INVENTION

This invention pertains to the fabrication of a customized precursor for use in carbon artifact manufacture. The customized precursor has a specific composition, because it is custom blended from individual and separate components and/or fractions of one or more pitches.

The various components fall within two major catagories: (1) the plasticizers or non-oxidizables; and (2) the hard, oxidizable fractions. These two parts of every precursor must be blended in proper proportions. In order to achieve a precursor having the desired rheology and chemical structure for spinning into carbon fibers, the precursor must contain a minimum amount of plasticizer components. In order to achieve high strength fibers, the precursor should contain a certain minimum amount of the hard, oxidizable components.

It has been determined that the blended precursor should have a given ratio by weight between oxidizable and non-oxidizable components, respectively, in an approximate range of 2.3 to 5.0, and preferrably 4.0.

Expressed an another way, the precursor should have a range of ratios between non-oxidizables and oxidizables of approximately 0.43 to 0.20 and preferably 0.25.

These ratios may also be expressed in terms of plasticizers versus non-plasticizers or toluene solubles versus toluene insolubles.

A high strength fiber will usually be derived from a precursor having a maximum percentage of plasticizing material of up to about 30% by weight. The plasticizer may comprise more than one component or at least one synthetic substance.

By blending various individual pitch components, a precursor can be obtained having a chosen chemistry. More than one feedstock can be used to provide specific precursor components.

A typical precursor material for the manufacture of a carbon artifact, can comprise the following approximate range percentage by weight of a group of components including:

Quinoline insolubles—0.0–30.0%
Quinoline solubles-Pyridine insolubles—25–45%
Pyridine solubles-toluene insolubles—35–55%
Toluene solubles-n-heptane insolubles—10–30%; and
n-heptane solubles—0.0–10.0%

Each component of the above precursor can be blended in a given ratio with respect to the total precursor. Also a given component can be added to a given pitch, pitch fraction, or pitch fraction derivative.

Each component of the precursor can be stored in individual bins or silos. A computer can be used to control the rate or quantity of components being discharged from the silos. Automatic balances may be used to measure the blending solids.

Each component of the custom blended precursor can be obtained from a pitch by solvent extraction prior to being stored.

The computer may also be used in the manufacturing process to synthetically prepare at least one component before blending takes place. The computer can be used to regulate the mixing of the components and any subsequent chemical or physical treatments.

It is an object of the invention to provide an improved precursor composition for manufacturing a carbon artifact, and a method of making same;

It is another object of this invention to provide a precursor that is custom blended from individual and separate components;

It is a further object of the invention to provide an improved method of blending a precursor to optimize its rheology and/or chemistry.

These and other objects of the invention will be better understood and will become more apparent with reference to the following detailed description considered in conjunction with the accompanying drawings.

DETAILED DESCRIPTION OF THE INVENTION

Generally speaking this invention pertains to the fabrication of a precursor used in the manufacture of a carbon artifact, such as carbon fibers. The invention features extracting individual components from mesophase pitches prepared from one or more feedstocks such as: (1) cat cracker bottoms; (2) steam cracker tars; (3) coal distillates; and (4) synthetics.

These components are then blended together in fixed proportions to obtain a customized precursor having given chemical and/or rheological characteristics. This customization will produce an optimized precursor, that is not generally producible by other methods, particularly when cross-blending various feedstock components.

Figure 1:
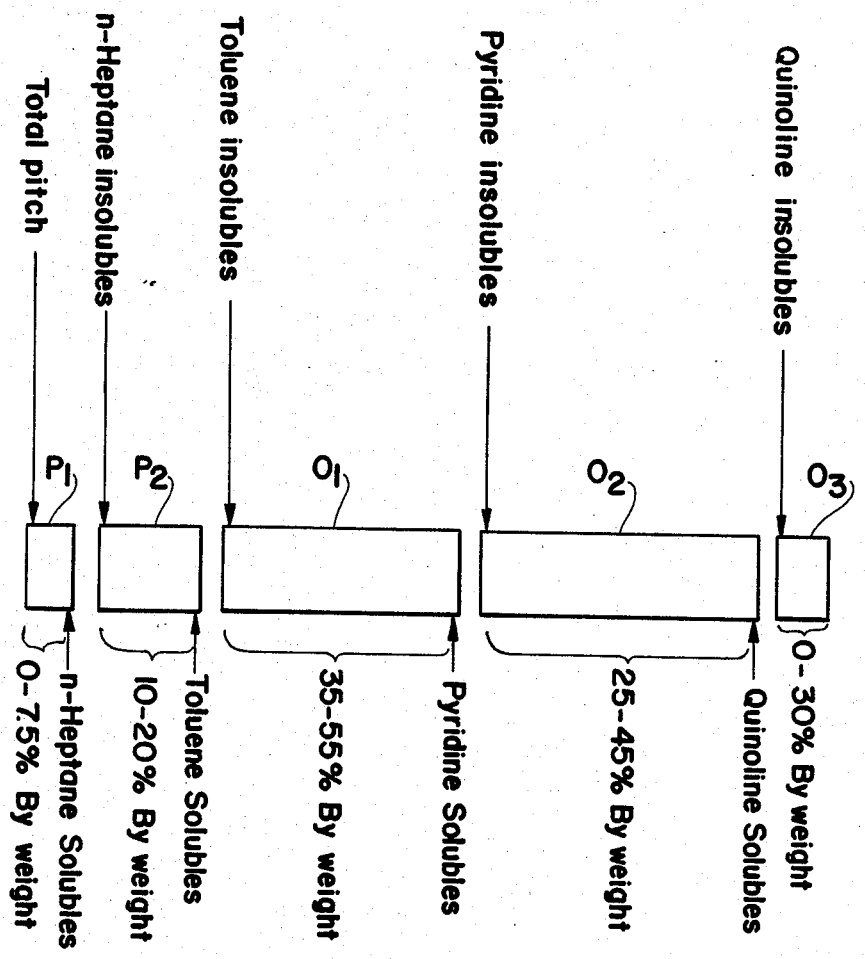
FIG. 1 is a schematic block diagram of the typical components of a blended precursor and their weight percent ranges.

Now referring to FIG. 1, a block diagram is shown of typical individual components $P_1$; $P_2$; $O_1$; $O_2$ and $O_3$ of a pitch derived from a feedstock such as a cat cracker bottom. These components can be obtained by standard solvent extraction techniques to provide eight different fractions as follows:

1. Quinoline Insolubles (fraction "$O_3$"). Extracted with Quinoline at 75° C.;

2. Pyridine Insolubles—Quinoline Solubles (fraction "$O_2$"). Extraction with pyridine at reflux and Quinoline at 75° C.

3. Pyridine Insolubles (fraction "$O_2+O_3$"). Extraction with pyridine at reflux;

4. Toluene Insolubles—Pyridine Solubles (fraction "$O_1$"). Extraction with Toluene and then Pyridine at reflux;

5. Toluene Insolubles (fractions "$O_1+O_2+O_3$" and "$P_1+P_2$"). Extraction with toluene at reflux;

6. n-Heptane Insolubles—Toluene Solubles (fraction "$P_2$"). Extraction by n-Heptane and then toluene at reflux; and 7. n-Heptane Solubles (fraction "$P_1$"). Extraction by n-Heptane at reflux.

The five individual components $P_1$; $P_2$; $O_1$; $O_2$ and $O_3$ can be custom blended in weight percentage ranges as shown. These ranges will generally provide workable precursors for the manufacture of carbon artifacts.

What particular percentage of any one component needed to form an optimized precursor will depend upon the desired characteristics called for in the final carbon artifact.

Figure 2:
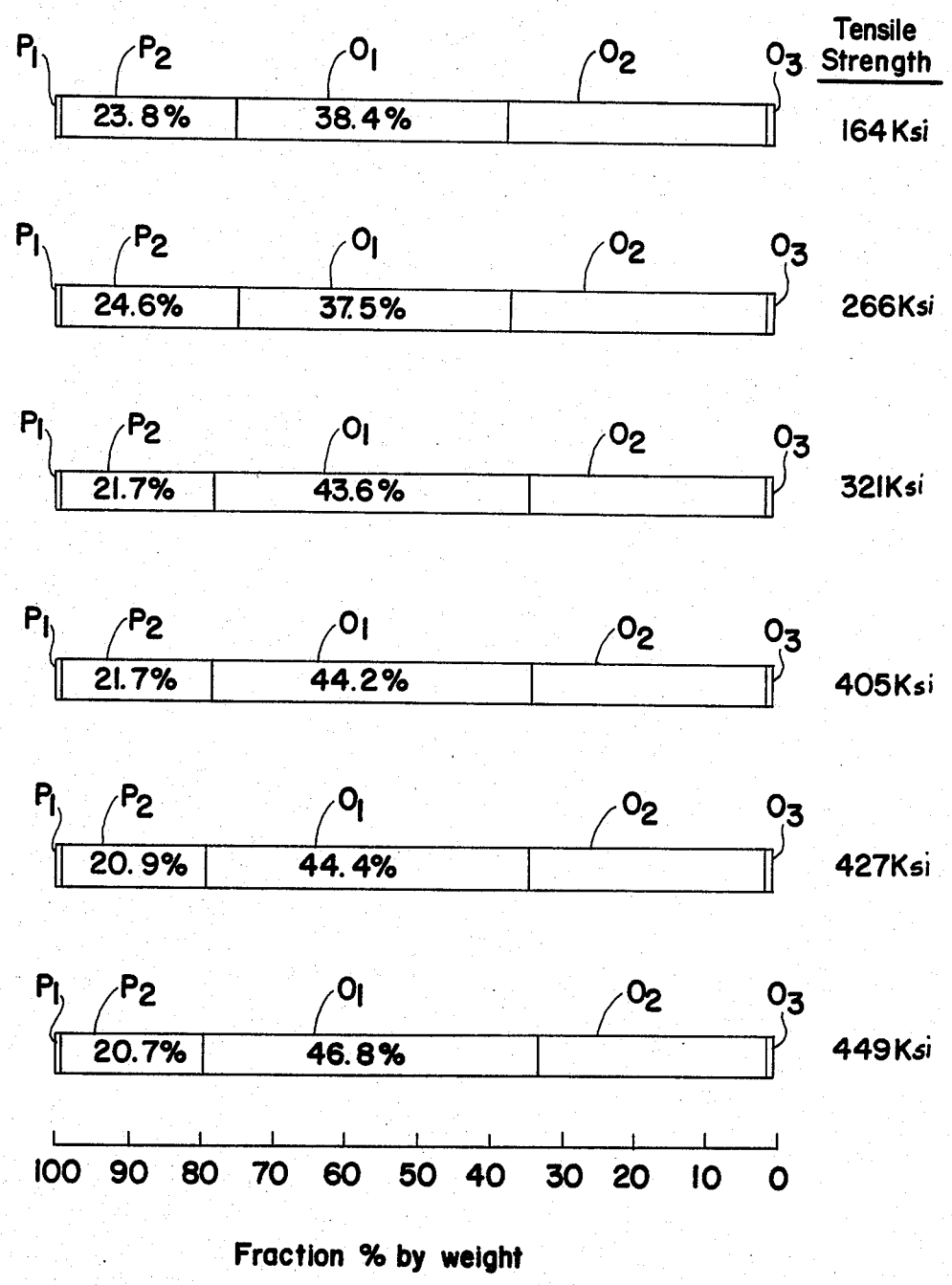
FIG. 2 is a schematic diagram of various blended precursors illustrating the relationship between change in component structure and ultimate tensile strength of carbonized fiber.

The relationship between ultimate tensile strength of spun carbon fibers and the percentage of components "$P_2$" and "$O_1$", is illustrated in FIG. 2. It can be seen from this figure, that as the oxidizable component "$O_1$" is increased, and the plasticizer component "$P_2$" is decreased, the tensile strength of the carbon fiber can be made to dramatically increase.

In normal extraction, heat soaking and percipitating techniques, a precursor cannot always be obtained having exact percentages of a particular component. Since tensile strengths can vary over a wide range with just small incremental changes in the components "$P_2$" and "$O_1$" it becomes startling to realize the tremendous advantage that custom blending can achieve.

With custom blending optimized precursors can be obtained that are not possible by other techniques.

The pitch fractions of FIGS. 1 and 2 were obtained from a heat-soaked Ashland-240 pitch which was prepared according to U.S. Pat. No. 4,219,404. The fractions were extracted by a two-stage extraction process discussed in U.S. Pat. Nos. 4,184,942; 4,219,404 and 4,271,006.

The aromatic pitch produced by heat-soaking vacuum stripped Ashland-240 at 395° C. for 1.0 hour (according to U.S. Pat. No. 4,219,404) was subjected to a two-stage extraction process as follows:

In the first stage, the crushed pitch was mixed with toluene and filter aid (at a specific pitch:toluene ratio), heated to reflux for one hour with continuous agitation and then filtered hot (90°–100° C.) to remove insolubles. In the second stage, the filtrated was then diluted at a specific pitch:solvent ratio with a blend of toluene and heptane (specific toluene:heptane ratio) and cooled to 20° C. over 4.0 hours to reject (precipitate) the desired fraction of the pitch. The pitch fraction was then filtered (centrifuge), washed first with toluene (specific pitch:toluene ratio) and finally with n-heptane (specific pitch:heptane ratio). The fraction was then dried at 120°–150° C. under reduced pressure for 12–16 hours.

The fractions were spun using a 200 micron hole spinnerette, the green fibers were then oxidized at 250° to 270° C./2–5 hours and then carbonized at 1500° to 1700° C. for 30 minutes.

Tables 1 and 2 below, present the weight percentages of the fractions and extraction ratios for each of the precursor components depicted in FIG. 2.

TABLE 1

| Example | n-Heptane insolubles (%) | Toluene Insolubles (%) | Pyridine Insolubles (%) | $P_1$ (%) | $P_2$ (%) | $O_1$ (%) | Tensile Strength (Kpsi) |
|---|---|---|---|---|---|---|---|
| 1 | 99.20 | 75.4 | 37.0 | 0.80 | 23.8 | 38.4 | 164 |
| 2 | 99.33 | 74.5 | 37.0 | 0.67 | 24.8 | 37.5 | 266 |
| 3 | 99.80 | 78.1 | 34.5 | 0.2 | 21.7 | 43.6 | 321 |
| 4 | 99.87 | 78.2 | 34.0 | 0.13 | 21.7 | 44.2 | 405 |
| 5 | 99.77 | 78.9 | 34.5 | 0.23 | 20.9 | 44.4 | 427 |
| 6 | 99.75 | 79.3 | 33.0 | 0.25 | 20.4 | 46.3 | 449 |

TABLE 2

| Example | 1 | 2 | 3 | 4 | 5 | 6 |
|---|---|---|---|---|---|---|
| First Stage Extraction | | | | | | |
| Pitch:Toluene Ratio | 1:1 | 1:1 | 1:1 | 1:1 | 1:1 | 1:1 |
| Time nouva | 1.0 | 1.0 | 1.0 | 1.0 | 1.0 | 1.5 |
| Second Stage Extraction | | | | | | |
| Pitch:solvent blend | 1:8 | 1:8 | 1:8 | | | |
| Toluene:Heptane ratio | 80:20 | 80:20 | 80:20 | 75:25 | 85:25 | 80:20 |
| Rejection Temp. (°C.) | 20 | 50 | 100 | 20 | 20 | 20 |

The characteristics of the various components is detailed below in Table 3:

TABLE 3

| | $P_1$ | $P_2$ | $O_1$ | n-Heptane insolubles | Toluene insolubles | Pyridine insolubles | Quinoline insolubles |
|---|---|---|---|---|---|---|---|
| Characteristics of Catalytic Cracking Residue Pitch Fractions | | | | | | | |
| Soft point (°C.) | 150 | 194 | 235 | 320+ | 320+ | 320+ | 320+ |
| Glass transition temperature (°C.) | 120 | 149 | 187 | 239 | 281 | 405 | 500 |
| Aromatic carbon | 80 | 91 | 94 | 94 | 94 | 94 | 94 |
| C/H atomic ratio | 0.8 | 1.4 | 1.60 | 1.60 | 1.85 | 1.85 | 1.96 |
| Optical Anistropy (%) | | | | | | | |
| Before melting | 0 | 0.1 | 1.0 | 100 | 100 | 100 | 100 |
| After melting | 0 | 5.0 | 100 | 100 | 100 | 100 | 100 |
| Oxidation Reactivity | | | | | | | |
| % Oxygen before oxidation | — | 1.18 | 1.40 | 1.22 | 0.80 | 1.28 | 0.95 |
| % Oxygen after oxidation | — | 1.42 | 6.62 | 6.50 | 11.00 | 10.83 | 9.60 |
| % Oxygen in oxygen | — | +0.2 | +5.2 | +5.28 | +10.20 | +9.55 | +8.65 |
| Volatiles % | | | | | | | |
| % at 370° C./15 min. | — | 7.4 | 2.6 | 1.2 | 0.4 | 1.8 | 2.0 |
| % at 400° C./15 min. | — | 10.2 | 3.0 | 1.4 | 0.6 | 3.8 | 8.7 |
| Characteristics of Heat-Soaked Ashland Pitch and Fractions | | | | | | | |
| Tg (°C.) | — | 50 | 140 | 233 | 450 | +450 | — |
| Aromatic Carbon (by NMR) | 61.0 | 89.2 | 92.4 | 91.1 | 91.1 | 92.1 | — |
| C/H atomic ratio | 0.70 | 1.16 | 1.70 | 1.74 | 1.69 | 1.83 | — |
| Optical Anistropy (%) | | | | | | | |
| Before melting | 0 | 0.1 | 1.0 | 100 | 100 | 100 | 100 |
| After melting | 0 | 1.0 | 100 | 100 | 100 | 100 | 100 |
| Oxidation Reactivity | | | | | | | |
| % Oxygen before oxidation | — | 1.45 | 1.33 | 0.50 | 0.70 | 0.76 | — |
| % Oxygen after oxidation | — | 2.81 | 8.87 | 9.45 | 13.55 | 12.59 | — |
| % Oxygen in oxygen | — | +1.36 | +7.54 | +8.9 | +12.8 | +11.83 | — |
| Volatiles % | | | | | | | |
| % at 370° C./15 min. | — | 17.4 | 1.0 | 8.0 | 5.0 | 2.7 | — |

The characteristics of the fractions composing a pitch are very different physically, thermally (volatilization, decomposition and coking), and chemically (aromaticity and carbon/hydrogen atomic ratio).

This invention has found that a correct proportion or ratio of the various fractions are absolutely necessary, especially the content of the softer plasticizer fraction and the harder toluene or pyridine insoluble fractions. In other words, the weight ratio of oxidizables versus non-oxidizables should be in an approximate range of 2.3 to 5.0. A correct quantity of the plasticizer is required to achieve a satisfactory softening and fluidity of the molten pitch for spinning of the molten mass into 8–12 micro fibers. Satisfactory softening and fluidity is required for the proper orientation of the mesophase in the spun carbon fiber.

The plasticizer fractions, which are defined as "$P_1$" and "$P_2$" can be prepared separately or combined together. These plasticizer fractions are prepared by extraction from a pitch or from a fraction of a pitch. Plasticizer, "$P_1$" is prepared by extracting the pitch (or fraction) with n-heptane at reflux conditions, filtering the insolubles and recovering plasticizer, "$P_1$" from the filtrate by distillation under reduced pressure or preferably by roto-evaporation or thin film evaporation under reduced pressure.

Plasticizer "$P_2$" is prepared by treating the n-heptane insolubles fraction of a pitch (or fraction) with toluene at reflux conditions, filtering the toluene insolubles and then recovering plasticizer "$P_2$" from the filtrate by distillation or roto-evaporation under reduced pressure.

The combined plasticizers, $P_1$ and $P_2$, can be prepared by extracting a pitch or a fraction with toluene at reflux conditions for one hour, filtering the toluene insolubles and then recovering the combined plasticizers from the filtrate by distillation, roto-evaporation or thin-film evaporation.

The high softening fractions which are suitable for blending can also be mixed with the one or two synthetic plasticizers to prepare the desired composition.

Pitch, toluene insolubles, pyridine insolubles or n-heptane insolubles can be prepared by other specific processes and conditions. The composition of any of the above fractions prepared by extraction vary according to the extraction condition and feed:solvent ratio used.

Figure 3:
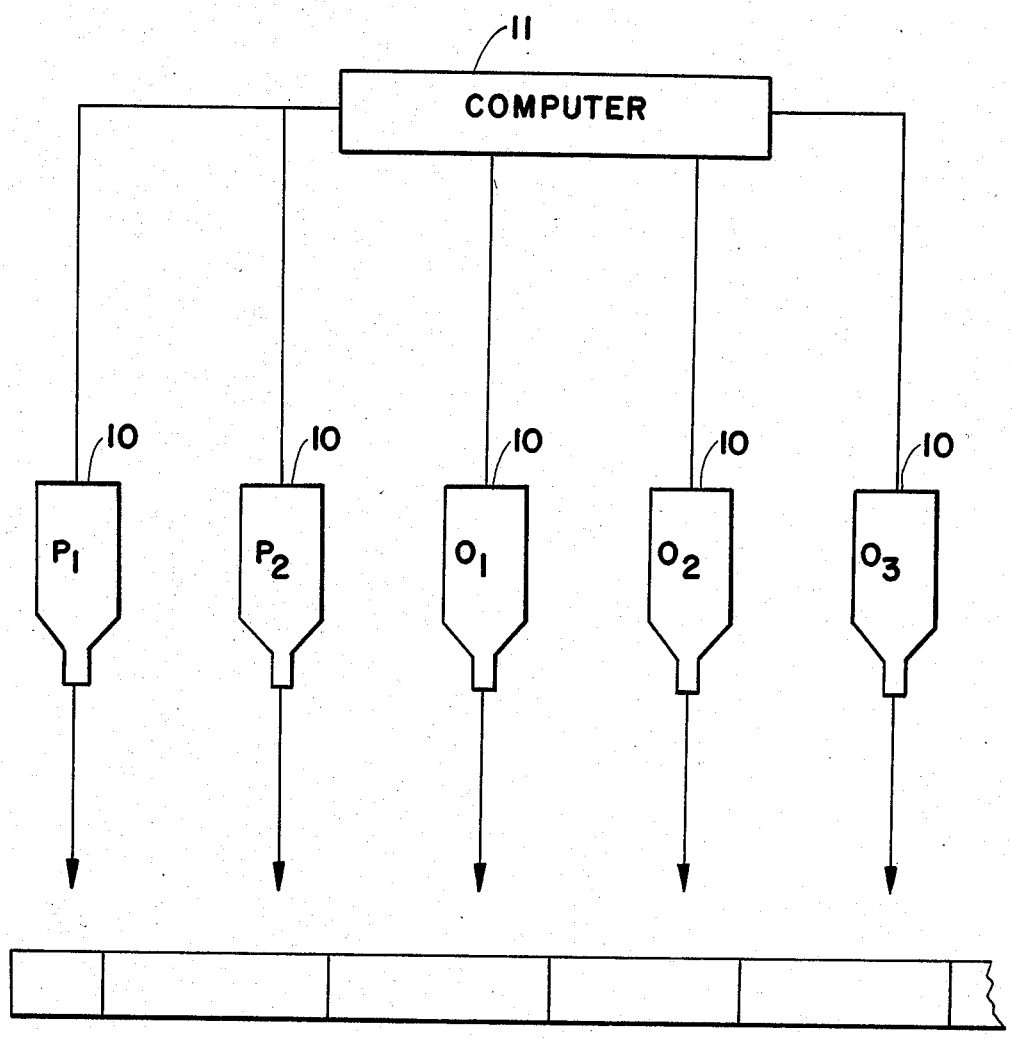
FIG. 3 is a schematic diagram of a computerized system for custom blending a precursor for carbon artifact manufacture.

The custom blending of this invention can be computer controlled as schematically depicted in FIG. 3.

Specific or individual components of one or more feedstocks can each be stored in respective bins or silos 10. A computer 11 is connected to each bin 10 to control the discharge rate or the amount of component materials dispensed from each silo 10, to provide a unique custom blended precursor.

The computer 11 can also be used to control or regulate other plant processes such as heat soaking, extraction, etc.

The unique precursor will comprise a given ratio of each component with respect to the total precursor, such that desired properties will obtain in the resulting carbon artifact.

The computer 11 may also be used to control or regulate the synthesis of synthetic components, the flow of materials in the manufacturing plant, and the rate of mixing and blending of the various components.

Having thus described in this invention, what is desired to be protected by Letters Patent is presented by the following appended claims.

What is claimed is:

1. A method of manufacturing a precursor material for the fabrication of carbon fibers comprising the step of custom blending the following separate pitch components:

10–30% by weight toluene solubles
0–10% by weight n-heptane solubles
25–45% by weight pyridine insolubles
35–55% by weight toluene insolubles
0–30% by weight quinoline insolubles wherein said toluene solubles and n-heptane solubles constitute a non-oxidizable fraction that is non-reactive with oxygen at 370° C. for a period of 15 minutes; and wherein said pyridine insolubles, toluene insolubles and quinoline insolubles constitute an oxidizable fraction that is reactive with oxygen at 370° C. for a period of 15 minutes.

2. The method of claim 1 wherein the non-oxidizable and oxidizable fractions are present in a weight ratio between 0.43 to 0.20.

3. The method of claim 1 wherein said non-oxidizable and oxidizable fractions are derived from at least one pitch.

4. The method of claim 1 wherein said components are derived from pitch feed stocks selected from the group consisting of cat cracker bottoms, steam cracker tars, coal distillates, and polycondensed aromatic materials.

* * * * *